US011624163B1

(12) United States Patent
Kulish

(10) Patent No.: US 11,624,163 B1
(45) Date of Patent: Apr. 11, 2023

(54) USE OF A SPIKE ROLLER ON AN EXPOSED CONCRETE SURFACE

(71) Applicant: Steelike, Inc., Springfield, VA (US)

(72) Inventor: William Thomas Kulish, Fairfax, VA (US)

(73) Assignee: STEELIKE, INC., Springfield, VA (US)

( * ) Notice: Subject to any disclaimer, the term of this patent is extended or adjusted under 35 U.S.C. 154(b) by 68 days.

(21) Appl. No.: 17/135,514

(22) Filed: Dec. 28, 2020

Related U.S. Application Data

(63) Continuation of application No. 16/501,131, filed on Aug. 22, 2019.

(51) Int. Cl.
*E01C 23/04* (2006.01)
*E01C 23/06* (2006.01)
*E04C 5/07* (2006.01)

(52) U.S. Cl.
CPC ..... *E01C 23/04* (2013.01); *E01C 23/06* (2013.01); *E04C 5/073* (2013.01)

(58) Field of Classification Search
CPC ..... E01C 23/04; E01C 23/06; E04C 5/073
USPC ..... 404/93, 94, 117, 122–124
See application file for complete search history.

(56) References Cited

U.S. PATENT DOCUMENTS 269,480 A * 12/1882 Stuart ..... E01C 19/236 404/124
993,086 A * 5/1911 Malloy ..... E01C 19/236 404/93
1,623,142 A 4/1927 Walsh
2,152,264 A * 3/1939 Loft ..... E01C 19/4826 404/124
3,832,079 A * 8/1974 Moorhead ..... B44B 5/0009 404/124
3,965,281 A * 6/1976 Takase ..... E04B 1/68 404/81
3,966,281 A 6/1976 Takase et al.
4,105,354 A * 8/1978 Bowman ..... B44B 5/0009 404/124
4,619,329 A * 10/1986 Gorbett ..... A01B 45/02 172/554

(Continued)

OTHER PUBLICATIONS

Ben Graybeal, "Design and Construction of Field-Cast UHPC Connections", U.S. Department of Transportation, Federal Highway Administration, Oct. 2014, 36 pages.

(Continued)

*Primary Examiner* — Raymond W Addie
(74) *Attorney, Agent, or Firm* — Mannava & Kang, PC

(57) ABSTRACT

According to examples, a method may include pouring a fluid ultra-high performance concrete (UHPC) mixture into a cavity, thereby providing a UHPC having at least one exposed surface. The method may include applying a liquid polymer onto the exposed surface of the UHPC, thereby providing a layer of liquid polymer onto the at least one exposed surface. According to examples, the method may include rolling the layer of the liquid polymer layer on the at least one exposed surface of the UHPC with a spike roller having a plurality of extended spikes. In some examples, the rolling may be applied with a predefined amount of pressure to cause the extended spikes to pierce the exposed surface of the UHPC, to incorporate the liquid polymer into the UHPC.

20 Claims, 5 Drawing Sheets

(56) References Cited

U.S. PATENT DOCUMENTS

| | | | | |
|---|---|---|---|---|
| 4,854,772 | A * | 8/1989 | Sinkkonen | E02D 3/026 404/124 |
| 5,111,627 | A * | 5/1992 | Brown | E04F 15/08 52/126.5 |
| 5,680,903 | A * | 10/1997 | Oliver | A01B 45/026 172/123 |
| 6,874,436 | B2 * | 4/2005 | Ranno | A01C 23/026 111/128 |
| 7,757,620 | B1 * | 7/2010 | French | A01C 7/04 111/91 |
| 2010/0098489 | A1 * | 4/2010 | Pollack | B28B 11/003 29/527.1 |
| 2010/0112329 | A1 * | 5/2010 | Yi | E01C 11/226 428/312.4 |
| 2014/0270957 | A1 * | 9/2014 | Lindley | B28B 11/0809 404/93 |

OTHER PUBLICATIONS

Alexander Wetzel, et al., "Microstructural investigations on the skinning of ultra-high performance concrete", Cement and Concrete Composites, vol. 57, Mar. 2015, 6 pages , ScieneDirect.

Yang Chen, et al., "Improvement of the surface quality and aesthetics of ultra-high-performance concrete", Construction Materials, vol. 172, Issue 5, Oct. 2019, 2 pages,ICE Virtual Library.

* cited by examiner

USE OF A SPIKE ROLLER ON AN EXPOSED CONCRETE SURFACE

RELATED APPLICATIONS

This application is a continuation of U.S. patent application Ser. No. 16/501,131, which in turn is converted from U.S. Provisional Patent Application No. 62/922,685, with a filing date of Aug. 22, 2019. The contents of these prior applications are incorporated herein by reference.

FIELD OF INVENTION

Concrete may be used to construct various types of structures. In some examples, an exposed surface of the concrete may be processed, for instance, by grinding down the concrete to provide a textured or a roughened surface.

DESCRIPTION OF RELATED ART

Concrete is used in constructing building, bridges, and roads. Concrete is often prepared as a ready mix at a central site and transported using a truck to a location where a wet concrete mix is then placed in a form. However, for larger construction projects, such transportation becomes costly and the quality of concrete could vary significantly, depending upon the weather and the distance between the central site and the project site where placement occurs. Alternatively, concrete may be prepared on location, the project site, using a portable concrete plant. However, existing portable concrete plants do not have sufficient temperature control mechanisms to deliver uniform quality concrete products, especially for ultra-high performance concrete.

Ultra-high performance concrete (UHPC) is a fiber-reinforced, portland cement-based product that provides advanced performance over traditional concrete, including excellent mechanical performance and resistance against environmental degradation. In FHWA Publication No. FHWA-HRT-19-011, the Federal Highway Administration (FHWA) defines UHPC as follows:

> UHPC is a cementitious composite material composed of an optimized gradation of granular constituents, a water-to-cementitious materials ratio less than 0.25, and a high percentage of discontinuous internal fiber reinforcement. In general, the mechanical properties of UHPC include compressive strength greater than 21.7 ksi (150 MPa) and sustained post-cracking tensile strength greater than 0.72 ksi (5 MPa). UHPC has a discontinuous pore structure that reduces liquid ingress, significantly enhancing durability compared to conventional concrete.

As an alternative to steel with properties more advanced than traditional concrete, UHPC technology is gaining credibility as the building material of the future. UHPC has been used in bridge structures in the U.S. from the early 2000s. Today, UHPC is gaining interest among transportation agencies especially as a joint fill material to connect precast structural systems. In addition to a structural material, UHPC can also be used as an architectural material. Due to UHPC's ductile behavior and decrease in the use of non-prestressed steel reinforcement, precast producers can achieve complex shapes that are durable and cost effective, with the resulting product requiring little or no maintenance.

Possible uses of UHPC in highway and bridges include constructing new highways and bridges out of UHPC or another self-leveling concrete, providing an overlay of UHPC, or another self-leveling concrete, on top of existing structures, as well as repairing joints in bridges and highways utilizing UHPC or a self-leveling concrete.

Challenges associated with utilizing self-leveling concrete, such as UHPC, in such highway and bridge applications include providing a roughened transportation surface while minimizing project cycle time to reduce highway or road closings and reducing the creation dust hazards onsite. A roughened surface is desirable to achieve minimize slippage and to reduce wear surface area of the road surface. Current method for providing a roughened surface is by grinding down over-filled concrete. This traditional method creates unwanted dust from the grinding and takes time and resources. An alternative method currently available is brushing the wet concrete surface.

A yet further challenge with using self-leveling concrete, such as UHPC, is the lack of a controlled delivery system, where a polymer additive such as a surface finishing agent, is needed to treat an exposed surface of UHPC. Incorporating such additive into the concrete mix prior to placement is cost prohibitive when such additive is only needed on the exposed surface of the concrete, and may interfere with the chemistry of the concrete mix. As a result, no surface finishing agent is currently used with UHPC.

SUMMARY OF THE INVENTION

The present invention is directed to a method of incorporating a liquid polymer into a concrete comprising:

- pouring a fluid concrete mixture into a cavity, thereby providing the concrete having at least one exposed surface,
- applying a liquid polymer onto the exposed surface, thereby providing a liquid polymer layer onto the exposed surface;
- rolling said layer of liquid polymer on the exposed surface with a spike roller having a plurality of extended spikes, wherein the rolling is applied with sufficient pressure to enable said extended spikes to pierce the exposed surface, thereby incorporating said liquid polymer into the concrete.

The present invention is also directed to a method of providing a textured surface onto a concrete comprising:

- pouring a fluid concrete mixture into a cavity, thereby providing the concrete having at least one exposed surface,
- rolling said exposed surface with a spike roller having a plurality of extended spikes, wherein the rolling is applied with sufficient pressure to enable said extended spikes to pierce the exposed surface, thereby creating a textured surface on the exposed surface, said textures surface having a texture that is a negative counterpart of the spike roller.

The present invention is additionally directed to a method of laying down fibers below an exposed surface of a concrete, the method comprising:

- providing a fluid concrete mixture, wherein said fluid concrete mixture includes a liquid component and at least one fiber selected from a metallic fiber and a polymeric fiber;
- pouring the fluid concrete mixture into a cavity, thereby providing the concrete having at least one exposed surface, said at least one exposed surface comprising exposed ends of said at least one fiber,
- rolling said exposed surface with a spike roller having a plurality of extended spikes, wherein the rolling is applied with sufficient pressure to enable said extended spikes to pierce the exposed surface, thereby laying down said exposed ends of the at least one fiber to below the exposed surface.

The present invention is further directed to a spike roller having a plurality of protruding spikes extending from a center core, at least one of said spikes having a tapered end with at least one profile surface that meets at a center point opposite the center core.

DETAILED DESCRIPTION OF THE INVENTION

Figure 1B:
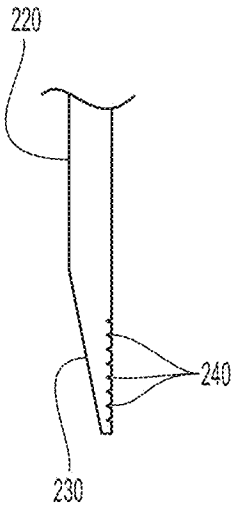
FIG. 1B shows a side perspective of the tapered end of a spike of the spike roller shown in FIG. 1.
Figure 1A:
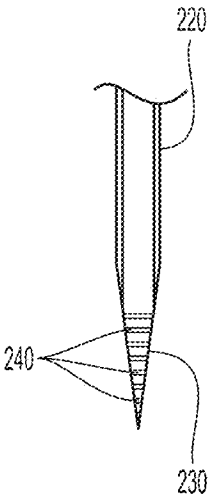
FIG. 1A shows a top perspective of the tapered end of a spike on the spike roller shown in FIG. 1.
Figure 1:
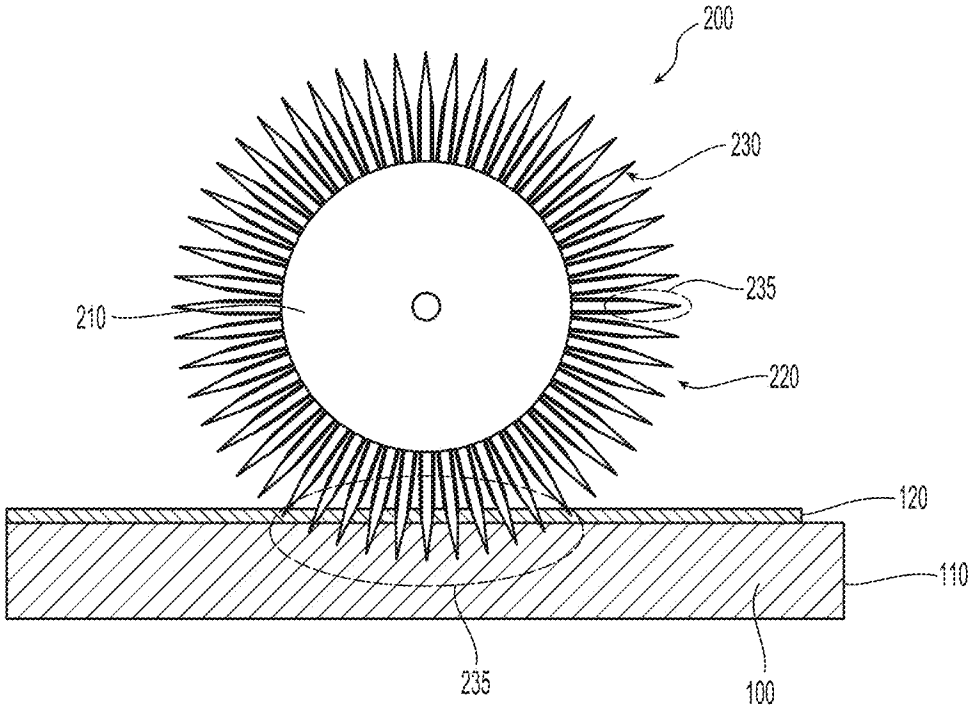
FIG. 1 shows a side perspective of a preferred embodiment incorporating a polymer layer into the exposed surface of a concrete.

The present invention relates to a method of incorporating a layer of liquid polymer into an exposed concrete surface by rolling the layer of liquid polymer on the exposed surface with a spike roller having a plurality of extended spikes, wherein the rolling is applied with sufficient pressure to enable the extended spikes to penetrate the exposed surface, thereby incorporating the liquid polymer into the formed concrete. A preferred embodiment is shown in FIG. 1, a fluid concrete mixture is placed through traditional methods to provide a concrete 100 in a cavity (not shown) with an exposed surface 110. A cavity can be a concrete form (or mold) or a crack or a joint between existing concrete. A layer of fluid polymer 120 is provided on top of the exposed surface 110 through traditional means, such as, for example using a spray nozzle. To incorporate the layer of fluid polymer 120 into the exposed surface 110, the method of the present invention uses a spike roller 200 having a plurality of spikes 220 extending from a center core 210. Preferably, each of the plurality of spikes 220 has a tapered end 230 that meets at a point 235 opposite of the center core 210. More preferably, as shown in FIGS. 1A and 1B, the tapered end 230 includes a number of grooves pointing downward to convey the polymer from the layer of fluid polymer 120 into the exposed surface 110. As the spike roller 200 is rolled across the layer of fluid polymer 120, an amount of pressure is applied on the spike roller 200 to enable the point 235 of the tapered end 230 to penetrate the layer of fluid polymer 120 and the exposed surface 110 as shown in 235.

Figure 2:
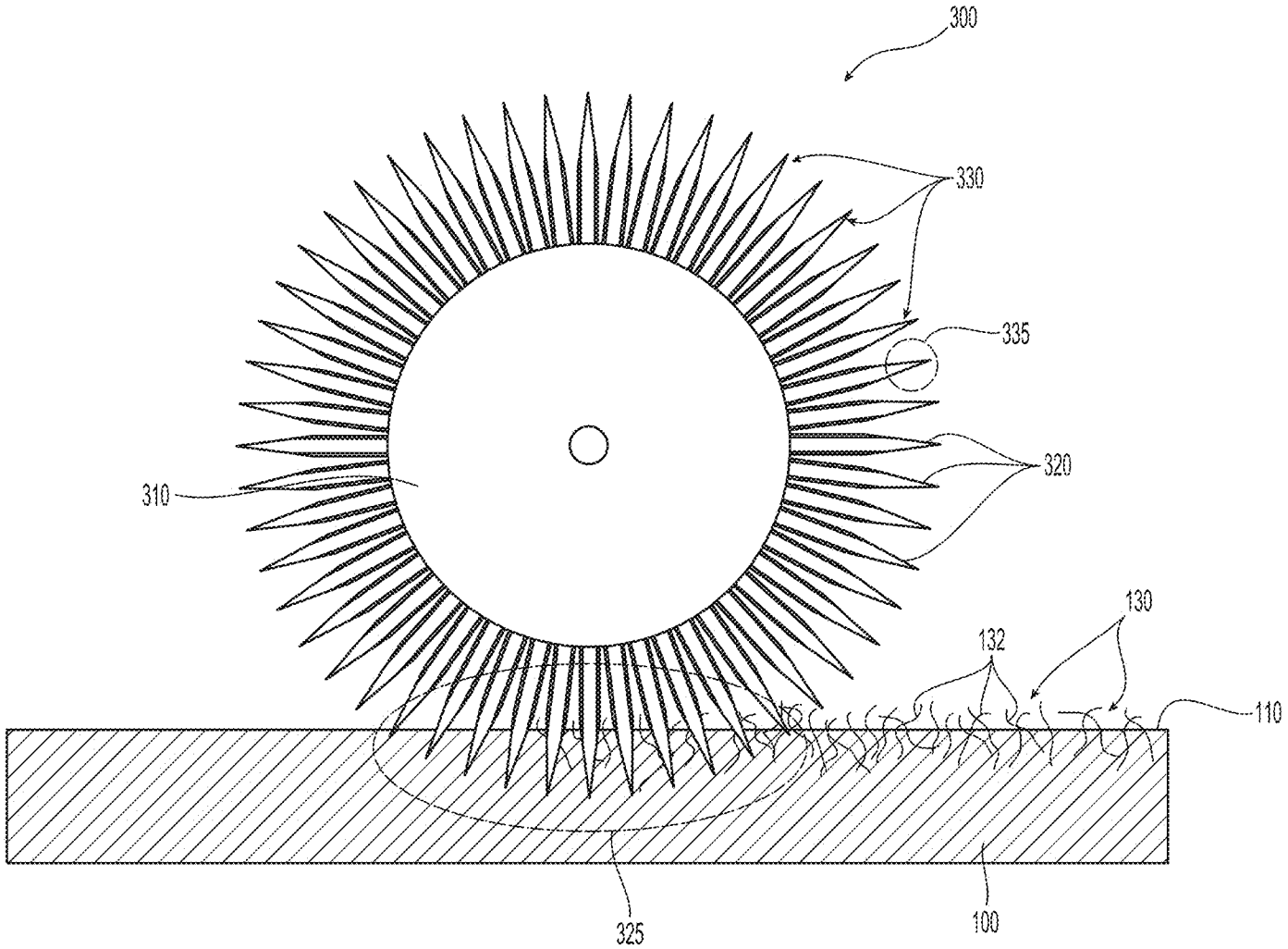
FIG. 2 shows a side perspective of a preferred embodiment of the method for laying down exposed ends of fibers in concrete.

The presentation invention also relates to a method of laying down exposed fiber components contained in concrete below an exposed surface of a concrete by rolling the exposed surface with a spike roller having a plurality of extended spikes, wherein the rolling is applied with sufficient pressure to enable said extended spikes to pierce the exposed surface, thereby laying down said exposed ends of the at least one fiber to below the exposed surface. As shown in FIG. 2, in a preferred embodiment, a fluid concrete mixture containing a plurality of fibers is placed through traditional methods to provide a concrete 100 with an exposed surface 110. The fibers can be either polymeric fibers or metallic fibers, or a combination of both. Inevitably, some of the fibers 130 will have an exposed end 132 sticking up from the exposed surface 110. In accordance to the present invention, a spike roller 300 having a plurality of spikes 320 extending from a center core 300 is used to lay down the exposed end of the fibers 132 beneath the exposed surface 110 of the concrete. The inventive method accomplishes this by rolling the spike roller 300 across the exposed surface 110 with sufficient pressure to have the spikes 320 penetrate the exposed surface 110 as shown in 325. In a further preferred embodiment the spikes 320 have a tapered end 330 that meet at a point 335 opposite the center core 310. In an even further embodiment, the distance between the point 335 of two adjacent spikes 320 is wide enough to allow the exposed end 132 of fibers to go between such adjacent spikes, as shown in 325. In a preferred embodiment, the profile of the tapered end 330 is an isosceles triangle with a base. The deepest that the spikes 320 will penetrate the exposed surface 110, if used correctly, is by not going beyond the base of the isosceles triangle or widest part of the triangle. Laying down the fibers in accordance to the present invention also release air bubbles from the concrete.

Figure 3:
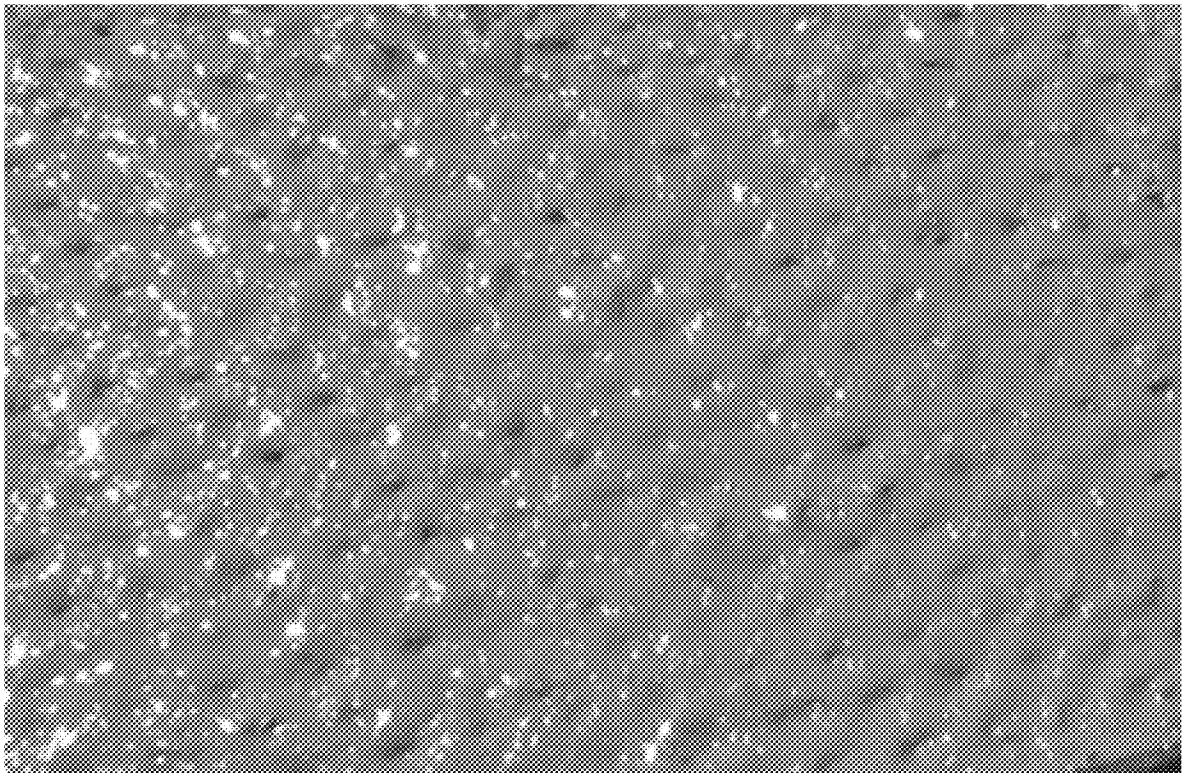
FIG. 3 shows a textured concrete surface made with a preferred embodiment of the spike roller of the present invention.

The present invention also relates to a method of providing a textured surface onto a concrete comprising rolling an exposed surface of the concrete with a spike roller having a plurality of extended spikes, wherein the rolling is applied with sufficient pressure to enable the extended spikes to penetrate the exposed surface, thereby creating a textured surface on the exposed surface, said textures surface having a texture that is a negative counterpart of the spike roller, as shown in FIG. 3.

Figure 4:
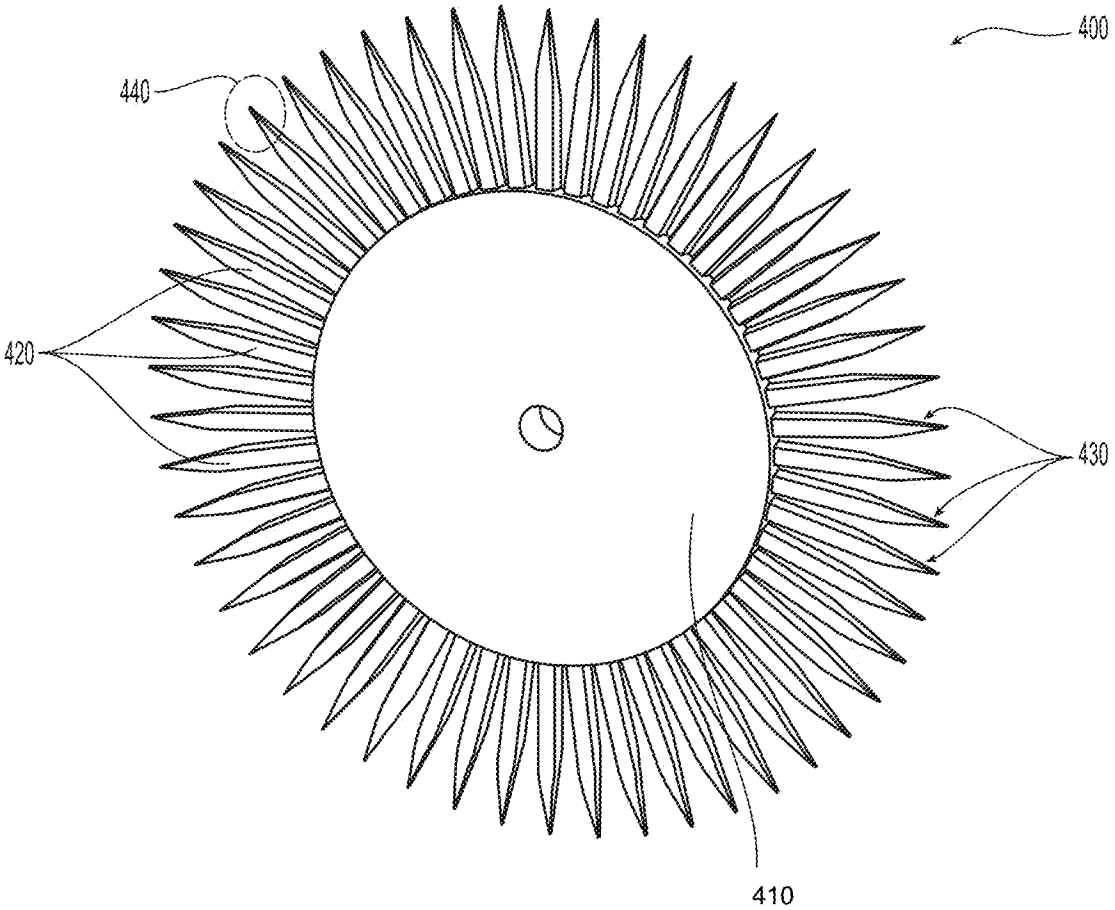
FIG. 4 provides a closeup side perspective of a spike roller of the present invention.
Figure 5:
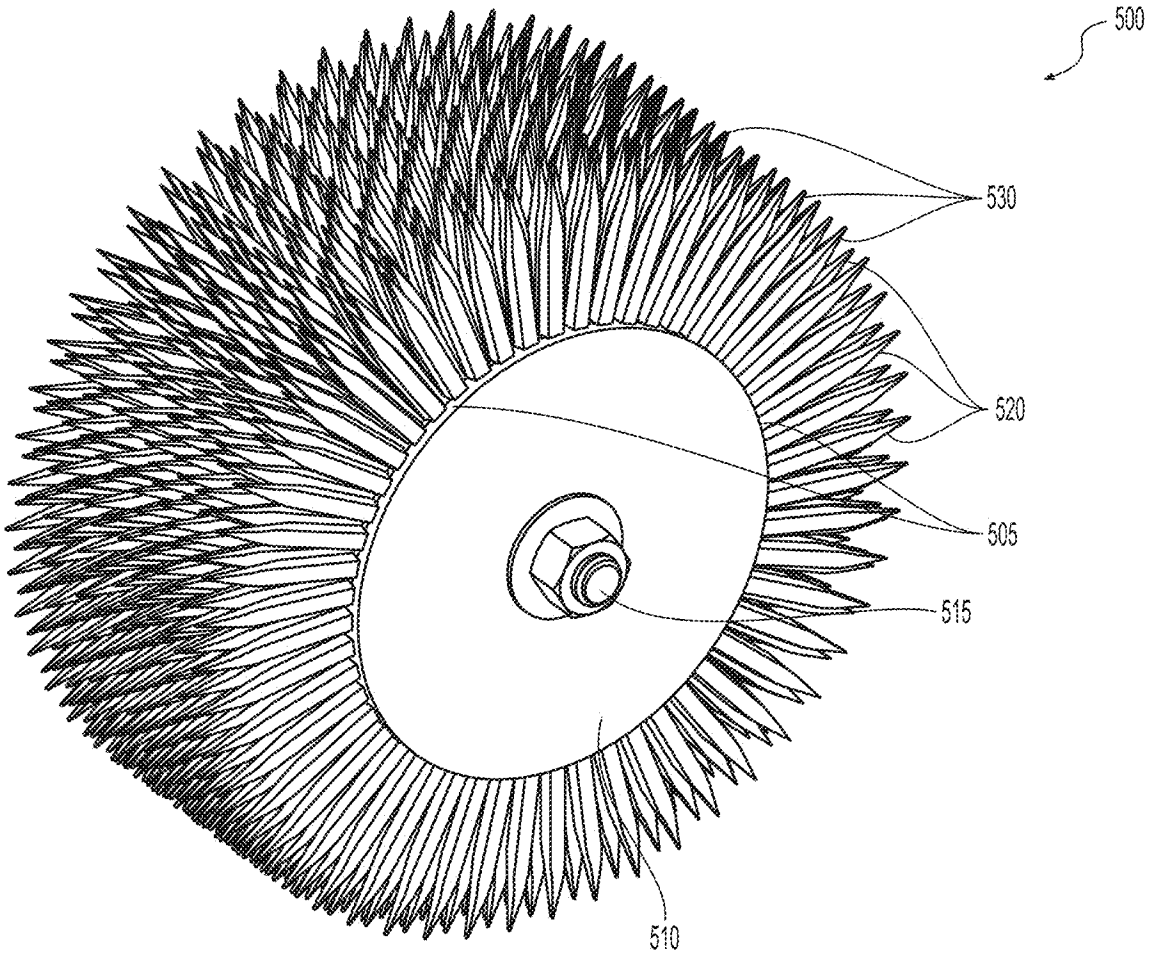
FIG. 5 shows an elevated perspective of a spike roller of the present invention.

The present invention additionally relates to a spike roller having a plurality of protruding spikes extending from a center core, at least one of said spikes having a tapered end with at least one profile surface that meets at a center point opposite the center core. As shown in FIG. 4, a preferred embodiment of the spike roller 400 of the invention is made of polymer resin with a center core 410 and a multitude of spikes 420 having a tapered end 430 that meet at a point 440 opposite the center core. As shown in FIG. 5, in a further preferred embodiment the spike roller 500 includes a number of spike plates 505, each with a plurality of spikes 520 extending from a center core 510 and a tapered end 530 opposite the center core. Each of the spike plates 505 are secured together at the center core 510. In a preferred embodiment, a handle (not shown) may be attached to the center core 510 in such a way that the axis of the handle is perpendicular to the axis 515 of the center core 510. In a further preferred embodiment, such a handle is attached in a way a equal number of spike plates 505 is disposed on both sides of the handle.

What is claimed is:

1. A spike roller comprising:

a center core having a rotational axis; and a plurality of protruding spikes that radially extend from the center core, wherein the spike roller is made of a polymer resin, the plurality of protruding spikes having:

a body that extends from the center core, wherein the body comprises a first surface that radially extends from the center core and a second surface that extends along the first surface, the first surface and the second surface facing opposite directions;

a tapered end portion disposed at a distal end of the body; and a plurality of grooves disposed on the first surface at the tapered end portion.

2. The spike roller of claim 1, wherein the first surface extends to a center point opposite the center core to form the tapered end portion.

3. The spike roller of claim 2, wherein the tapered end portion has an isosceles triangle shape.

4. The spike roller of claim 1, wherein the tapered end portion is configured to be rolled over a layer of liquid polymer disposed on an exposed surface of a concrete at a sufficient pressure to pierce the exposed surface of the concrete through the layer of the liquid polymer.

5. The spike roller of claim 4, wherein the plurality of grooves are configured to cause the liquid polymer to flow into the concrete to be incorporated into a mixture of the concrete.

6. The spike roller of claim 4, wherein the plurality of grooves are configured to cause the liquid polymer to be incorporated into a portion of a mixture of the concrete at the exposed surface of the concrete, the liquid polymer being a surface finishing agent that is to be incorporated into the mixture of the concrete to treat the exposed surface of the concrete.

7. A spike roller comprising:

a center core having a rotational axis; and a first protruding spike that radially extends from the center core;

a second protruding spike that radially extends from the center core in a direction different than the first protruding spike;

a first plurality of grooves disposed on the first protruding spike, wherein, when the first protruding spike is positioned to point toward a surface to be rolled, the first plurality of grooves point toward the surface; and a second plurality of grooves disposed on the second protruding spike, wherein, when the second protruding spike is positioned to point toward the surface, the second plurality of grooves point toward the surface.

8. The spike roller of claim 7, wherein the spike roller is made of a polymer resin.

9. The spike roller of claim 7, wherein the spike roller is made of a polymer resin.

10. The spike roller of claim 7, wherein the first protruding spike comprises:

a tapered end portion disposed at a distal end of the first protruding spike, wherein the first plurality of grooves are disposed on the tapered end portion.

11. The spike roller of claim 10, wherein a length of the first protruding spike is greater than a width of the first protruding spike.

12. The spike roller of claim 10, wherein the tapered end portion extends to a center point opposite the center core.

13. The spike roller of claim 12, wherein the tapered end portion forms an isosceles triangle shape.

14. The spike roller of claim 7, wherein the center core is configured to be rolled of at a sufficient pressure to cause the first protruding spike to pierce the surface through a layer a liquid polymer disposed on the surface.

15. The spike roller of claim 14, wherein the first plurality of grooves are configured to cause the liquid polymer to flow below the surface to be incorporated into a concrete mixture.

16. The spike roller of claim 14, wherein the first protruding spike is configured to incorporate a surface finishing agent in the layer of the liquid polymer into a concrete mixture, the surface finishing agent being incorporated into a portion of the concrete mixture at the surface.

17. A spike roller comprising:

a center core having a rotational axis; and plurality of protruding spikes that extend from the center core, wherein the spike roller is made of a polymer resin, the plurality of protruding spikes having:

a tapered end portion disposed at a distal end of the plurality of protruding spikes; and a plurality of grooves disposed on the tapered end portion of the plurality of spikes, wherein the tapered end portion of adjacent ones of the plurality of protruding spikes are positioned at a predefined distance with respect to each other to accommodate a protruding end of a fiber in a fiber-reinforced concrete, the tapered end portion being configured to cause the protruding end of the fiber to be laid down in the fiber-reinforced concrete as the plurality of spikes are rolled over the fiber-reinforced concrete.

18. The spike roller of claim 17, wherein the spike roller is configured to be rolled over an exposed surface of the fiber-reinforced concrete to cause the tapered end portion to pierce the exposed surface of the fiber-reinforced concrete and lay down the protruding end of the fiber into a body of the fiber-reinforced concrete, below the exposed surface.

19. A spike roller comprising:

a center core having a rotational axis;

a plurality of protruding spikes that radially extend from the center core, wherein the spike roller is made of a polymer resin, the plurality of protruding spikes having:

a tapered end portion disposed at a distal end of the plurality of protruding spikes, wherein the tapered end portion has a first surface that extends to a center point opposite the center core and a second surface that is opposite the first surface, the first surface and the second surface having isosceles triangle shapes; and a plurality of grooves disposed on the first surface of the tapered end portion of each of the plurality of protruding spikes.

20. The spike roller of claim 19, wherein the tapered end portion is configured to be rolled over a layer of a liquid polymer disposed on an exposed surface of a concrete mixture, the tapered end portion being configured to be rolled at a sufficient pressure to pierce the exposed surface of the concrete mixture through the layer of the liquid polymer to cause the liquid polymer to flow into the concrete mixture via the plurality of grooves.

* * * * *